US005377400A

United States Patent [19]

Homm

[11] Patent Number: 5,377,400

[45] Date of Patent: Jan. 3, 1995

[54] JOINTING CLAMP AND METHOD FOR PRESSING PIPE CONNECTIONS

[75] Inventor: Karl-Georg Homm, Marl-Polsum, Germany

[73] Assignee: Hewing GmbH, Ochtrup, Germany

[21] Appl. No.: 149,573

[22] Filed: Nov. 9, 1993

Related U.S. Application Data

[62] Division of Ser. No. 830,815, Feb. 4, 1992, Pat. No. 5,307,664.

[30] Foreign Application Priority Data

Mar. 18, 1991 [DE] Germany ..... 9103264

[51] Int. Cl.[6] ..... B21D 39/04

[52] U.S. Cl. ..... 29/517; 29/237; 72/401; 72/461; 72/416

[58] Field of Search ..... 29/516, 517, 508, 237, 29/751; 72/401, 400, 410, 409, 461, 453.16, 453.15, 416

[56] References Cited

U.S. PATENT DOCUMENTS

| | | | |
|---|---|---|---|
| 1,353,719 | 9/1920 | Buresch | 72/400 |
| 1,722,279 | 7/1929 | Davis | 72/409 |
| 2,086,400 | 7/1937 | Brenizer | 72/410 |
| 2,211,008 | 8/1940 | Goldberg | 72/401 |
| 2,292,421 | 8/1942 | Wolf | 29/516 |
| 2,314,236 | 3/1943 | Mott | 29/516 |
| 2,582,056 | 1/1952 | Mount | 72/400 |
| 3,120,772 | 2/1964 | Mixon | 72/410 |
| 3,332,272 | 7/1967 | Tonchen | 72/410 |
| 3,571,890 | 3/1971 | Brehm | 72/410 |
| 3,689,112 | 9/1972 | Slator | 29/516 |
| 3,756,064 | 9/1973 | Erdmann | 72/410 |
| 3,769,678 | 11/1973 | Marsden | 29/517 |
| 3,771,343 | 11/1973 | Dawson | 72/402 |
| 5,080,406 | 1/1992 | Hyatt | 29/517 |
| 5,148,698 | 9/1992 | Dischler | 72/410 |

*Primary Examiner*—Daniel C. Crane
*Attorney, Agent, or Firm*—Jordan and Hamburg

[57] ABSTRACT

A jointing clamp for pressing pipe connections, particularly for pipes of composite materials, includes two pressure clamps, each of which carries a form part of a form insert and which are connected with one another by connecting plates that are disposed on either side, and which are supported at the connecting plates so that they are can be pivoted in opposite directions about parallel pivoting axes and can be moved into the closed position by means of a clamp driving device which can be connected to the jointing clamp by means of a cross-bolt reaching through aligned boreholes in the connecting plates. In order to achieve a pressed pipe connection of high form accuracy, the form insert is constructed in three parts and the third form part is supported in a stationary manner between the connecting plates of the jointing clamp.

25 Claims, 8 Drawing Sheets

JOINTING CLAMP AND METHOD FOR PRESSING PIPE CONNECTIONS

This is a division, of applications Ser. No. 07/830,815, Feb. 4, 1992, now U.S. Pat. No. 5,307,664.

The invention relates to a jointing clamp for pressing pipe connections, particularly for pipes of composite materials.

BACKGROUND OF THE INVENTION

Known jointing clamps of this type (German patent 27 25 280) have a two-part form insert in which the parts of the form insert extend over a central angle of 180°. The parting line between the two parts of the mold coincides with the longitudinal center plane of the jointing clamp, about which the two pivoting axes of the pressure clamps are disposed in mirror image fashion.

SUMMARY OF THE INVENTION

It is an object of the invention to provide a jointing clamp of the initially named type, in which the form parts act more uniformly on the parts of the pipe connection that are to be pressed and the pressed pipe connections have a particularly highly accurate shape.

The inventive jointing clamp produces pressed pipe connections, which have a particularly accurate shape, especially in the case of a circular basic form. At the same time, the forces employed for the pressing, distributed better over the periphery by the form parts, are transferred to the parts of the pipe connection with the result that, while avoiding material distortions and the therewith associated damage to the structure of the material, a clean transformation with a largely radial alignment of the forces acting takes place.

Further details and advantages arise out of the following description and the drawing, in which an embodiment of the object of the invention is illustrated in greater detail. The following is shown in the drawings:

DESCRIPTION OF THE PREFERRED EMBODIMENTS

Figure 1:
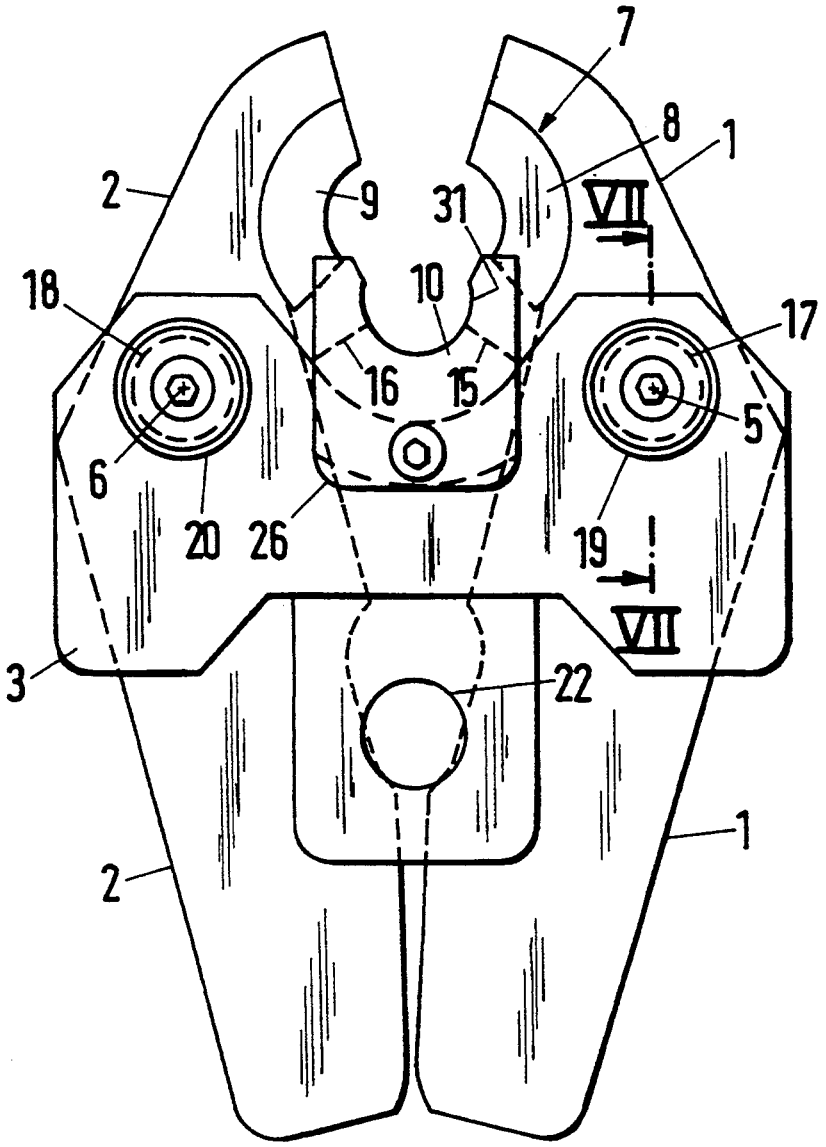
FIG. 1 shows a side view of the jointing clamp with its pressure clamps in the open position.
Figure 2:
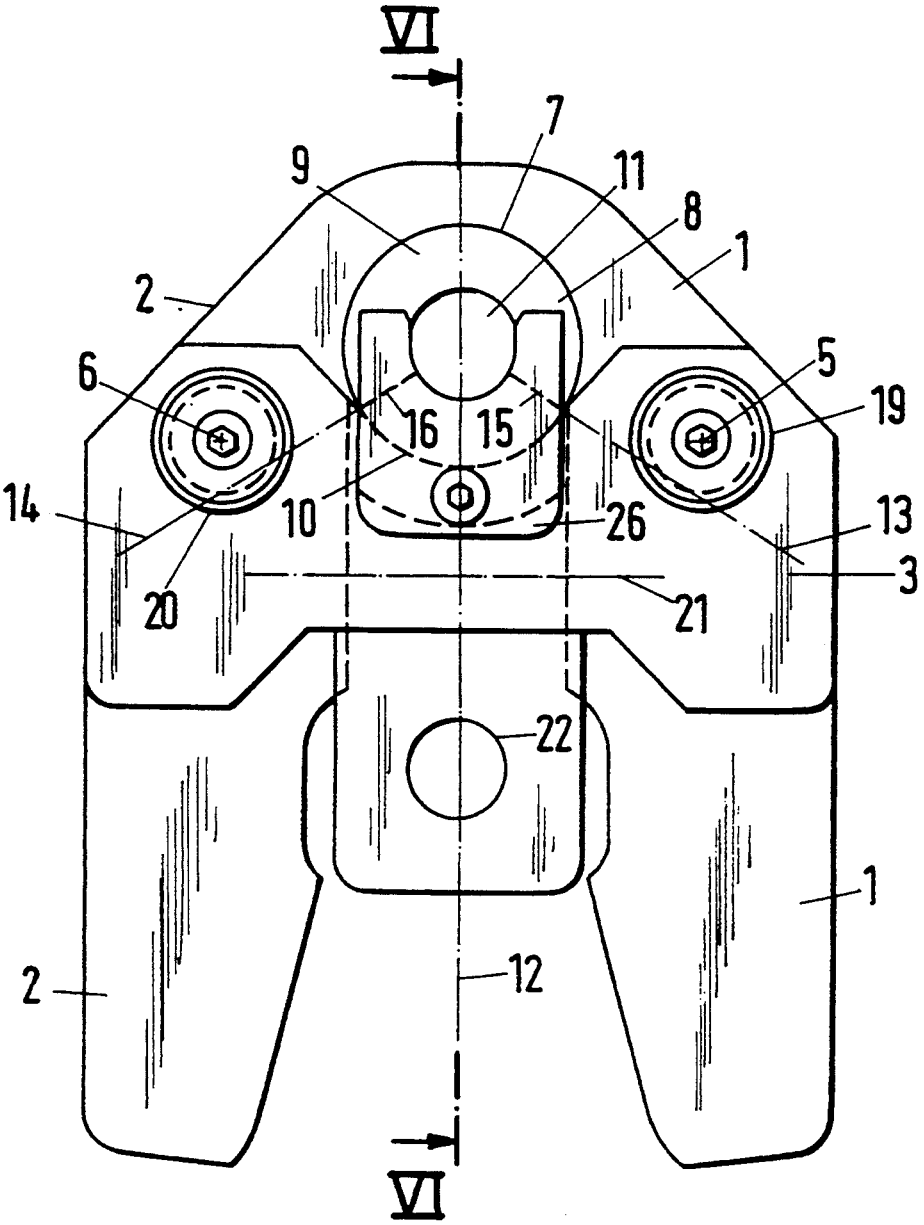
FIG. 2 shows a representation of the jointing clamp with its pressure clamps in the closed position.
Figure 3:
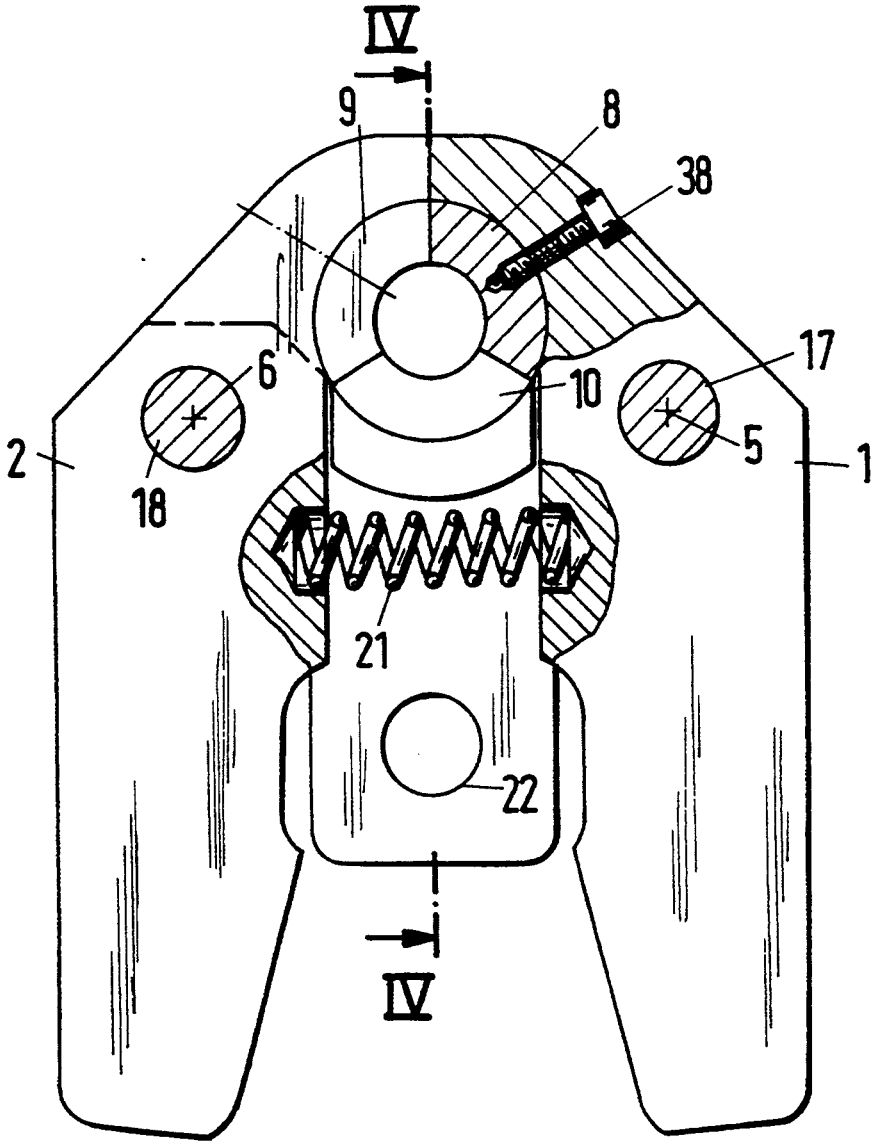
FIG. 3 shows a view that is similar to that of FIG. 2, in a partially simplified, partially sectional version.

The jointing clamp, which is illustrated in the drawing for pressing pipe connections, particularly for pipes of composite materials, comprises two pressure clamps 1, 2, which are connected together by connecting plates 3, 4 disposed on either side and are supported at the connecting plates 3, 4 so that they can be pivoted in opposite directions about the parallel pivoting axes 5, 6. The jointing clamp furthermore comprises a form insert 7, which is formed from three form parts 8, 9, 10, which in the closed position constitute the common boundary of a form opening 11. A form part 8, 9 is assigned to each of the pressure clamps 1, 2 and the third form part 10 is supported in a stationary manner between the connecting plates 3, 4 of the jointing clamp.

The third form part 10, which is supported in a stationary manner, is arranged symmetrically to the longitudinal center plane 12 of the jointing clamp and has a central angle, which is either equal to the central angle of the two movable form parts 8, 9 or greater than their central angle, which can be advantageous particularly in the case of pipe connections with larger external diameters.

Figure 7:
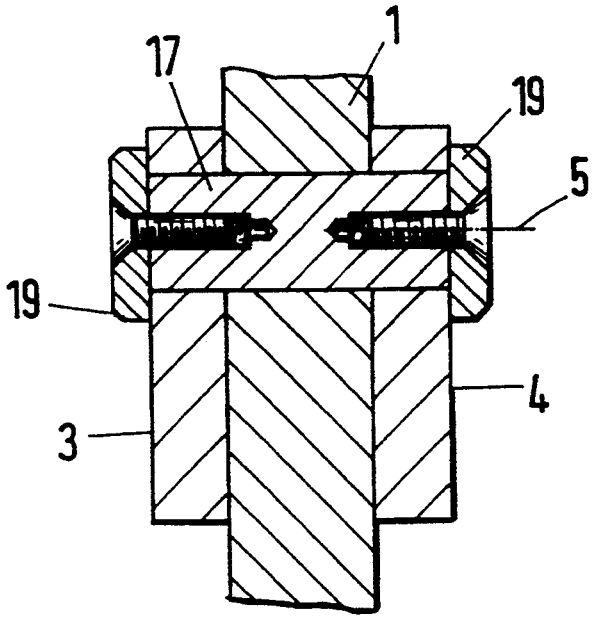
FIG. 7 shows a truncated partial section through the jointing clamp along the line VII—VII of FIG. 1.

The pivoting axes 5, 6 advantageously lie above an imaginary extension 13, 14 of the parting plane 15, 16 between in each case two adjacent form parts 8, 10 or 9, 10 in order to improve the central alignment of the pressing forces, which the form parts 8, 9 and, derived therefrom, the form part 10 exert on the parts of the pipe connection during the closing of the jointing clamp. The pivoting axes 5, 6 are aligned in mirror-image fashion to the longitudinal center plane 12 of the jointing clamp. They are defined by a hinge pin 17 or 18, which, as shown for the hinge pin 17 in FIG. 7, reaches through the associated pressure clamps 1 or 2 and the two connecting plates 3, 4 and is secured by the retaining screws 19, 20.

Figure 8:
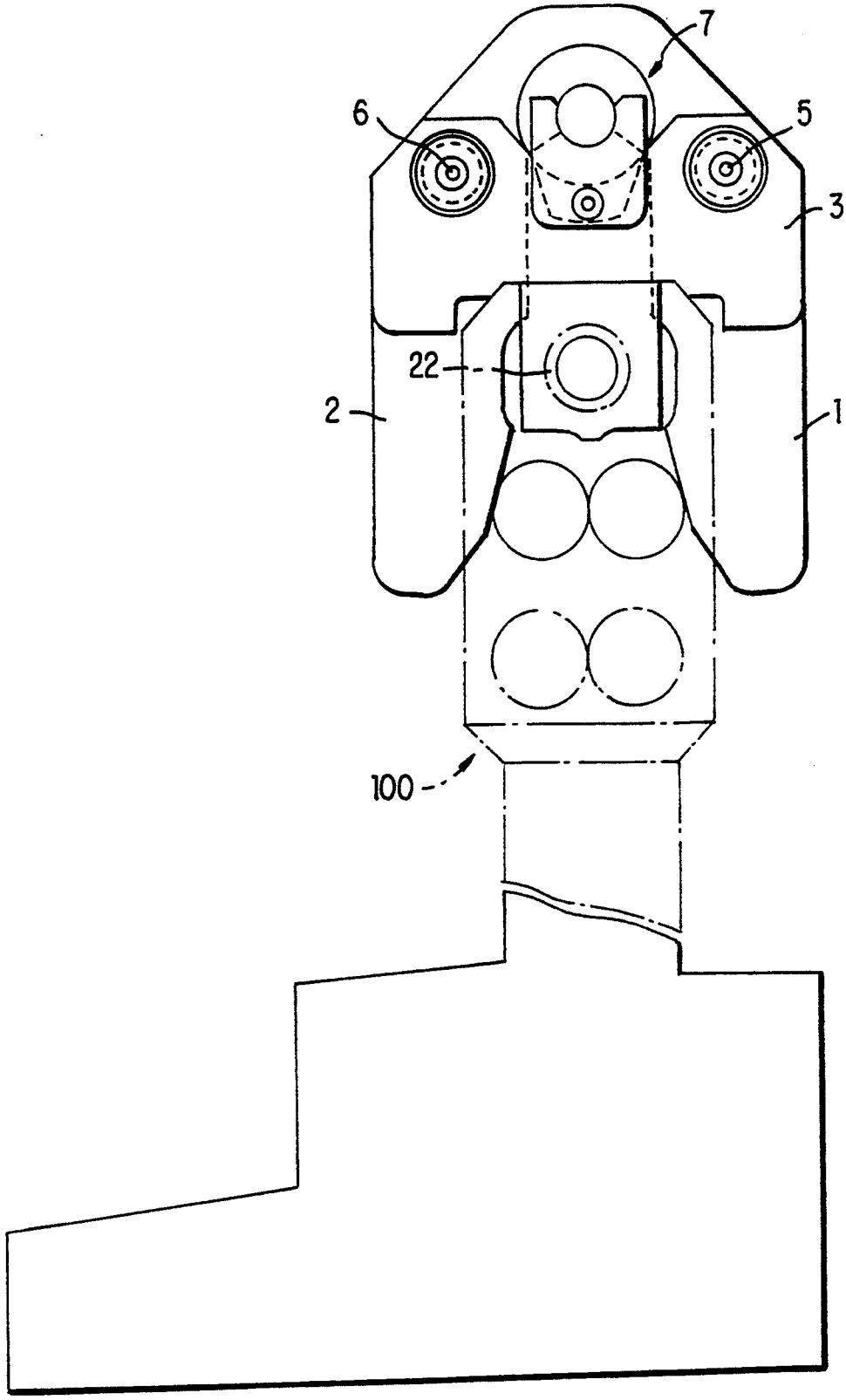
FIG. 8 shows a representation of the jointing clamp, similar to FIG. 2, along with the clamp driving device therefor, the clamp driving device being well-known.

In the closing direction, the two pressure clamps 1, 2 are under the tension of a spring 21, such as a spiral pressure spring, which acts between these two pressure clamps 1, 2 and is supported below the stationary form part 10, so that, after the jointing clamp is placed on the parts of the pipe connection that are to be pressed, the jointing clamp achieves a self-locking hold on these parts and can be let go, in order to be able to connect a clamp driving device 100 (FIG. 8 ) by means of a cross-bolt reaching through aligned boreholes 22, 23 in the connecting plates 3, 4. Such a clamp driving device can have a hydraulic, pneumatic or other suitable driving device for the forked parts, which grasp behind the free ends of the pressure clamps 1, 2 on the inside and pivot them outwards in opposite directions.

Figure 4:
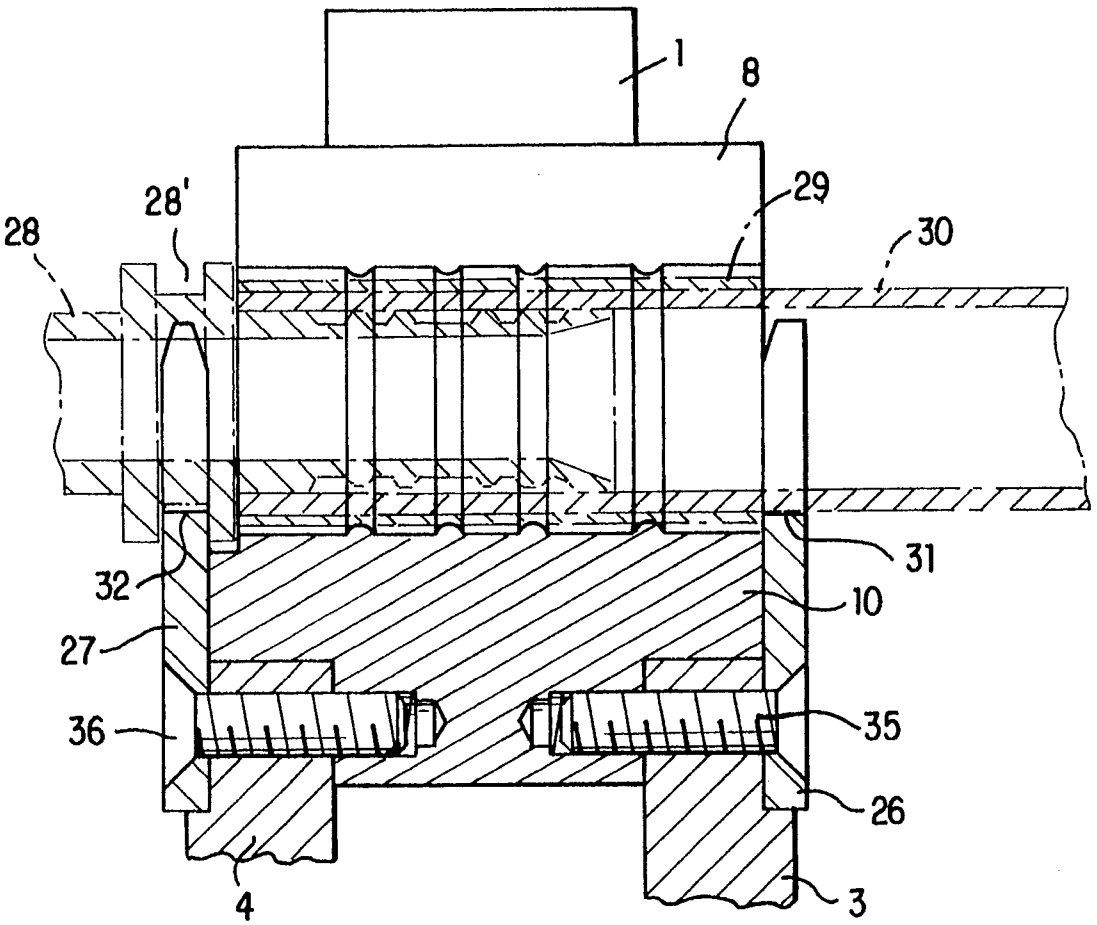
FIG. 4 shows a truncated cross section through the jointing clamp along the line IV—IV of FIG. 3.
Figure 5:
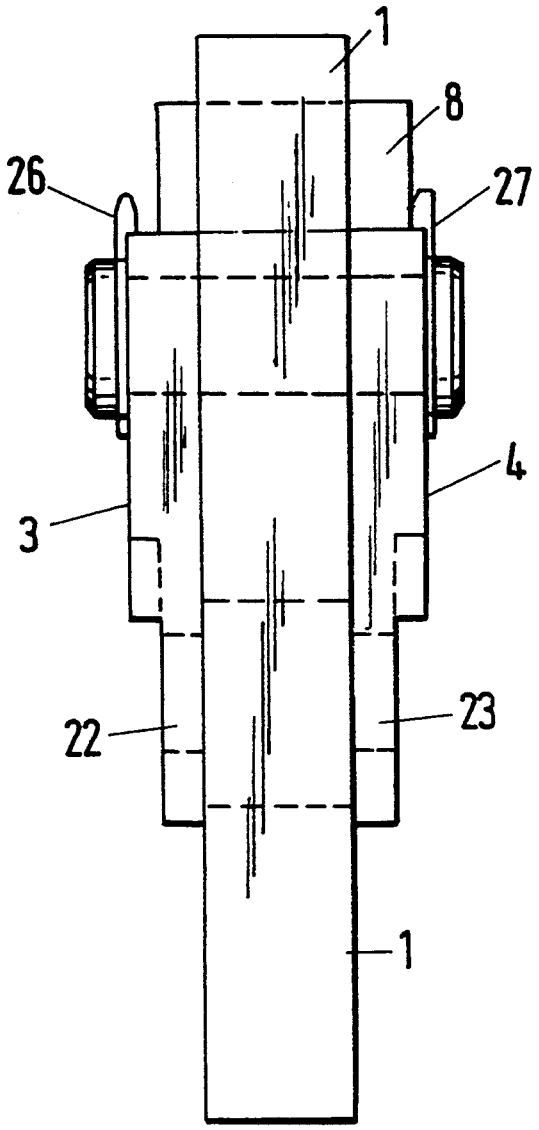
FIG. 5 shows a front view of the jointing clamp of FIG. 2.

A guide plate 26, 27 for parts of the pipe connection is provided on each of the two outer sides of the connecting plates 3, 4 and is indicated by a broken line or a dot-dash line in FIG. 4. It comprises a supporting sleeve 28 with a centering groove 28' in a central region, a pressing sleeve 29 and a pipe 30, which can consist of plastic, a metallic material or preferably also of composite materials, such as aluminum and cross-linked polyethylene.

Both guiding parts 26, 27 have the shape of a forked plate and, between their forked legs, have a form recess 31, 32, which in each case is made to fit a part of the pipe connection. The form recesses 31, 32 of the two guiding parts 26, 27 can be identical, so that the jointing clamp can engage the parts of the press connection from either side. In the press connection shown in FIG. 4, this presupposes that the diameter of the bottom of the groove 28 and the external diameter of the pipe 30 are the same.

The form recesses 31, 32 may, however, also be different in such a way, that the form recess 32 is made to fit the groove 28' of the supporting sleeve 28 and the form recess 31 is made to fit the periphery of the pipe 30, if this has different dimensions.

Figure 6:
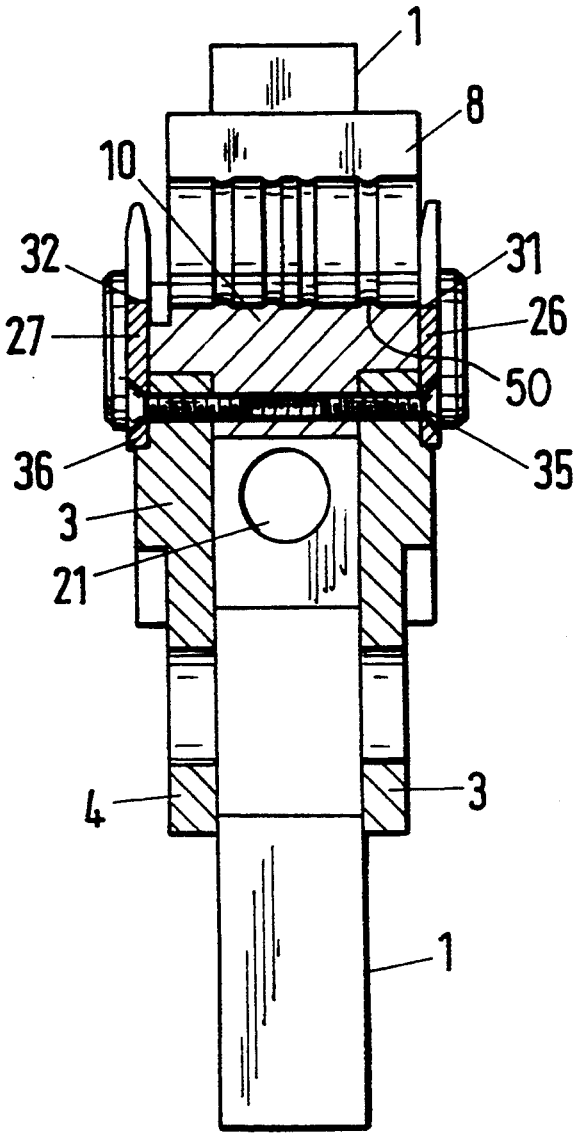
FIG. 6 Shows a cross section through the jointing clamp along the line VI—VI of FIG. 2.

The guide parts 26, 27 are preferably fixed by means of retaining screws 35, 36 (FIG. 6), so that they are detachable and can be exchanged for replacement parts or guide parts with other form recesses. The form parts 8, 9, 10, which likewise are detachably fixed by screws, can also be exchanged. Screws 35 and 36 fix the stationary form part 10 and form parts 8, 9 are fixed to the pressure clamps 1, 2 by screws, of which the one for form part 8 is illustrated and labeled 38.

When the jointing clamp (FIG. 1) is open, the parts 28, 29, 30 of the form connection are inserted in the jointing clamp, the guide parts 26, 27 bringing about an exact fixation in the axial direction of the parts in the jointing clamp. As a result, the form ribs 50 (FIG. 6) on the form parts 8, 9, 10 align exactly with those form hollows, which have been provided in the supporting sleeve 28. This ensures a particularly precise pressing, which guarantees a tight connection of the parts and avoids damage to the structure, which could occur if the regions of the pipe connection that are to be pressed are not aligned properly in the axial direction with the form parts of the form insert 7.

What is claimed is:

1. A jointing clamp which is operable to join together a pipe, a supporting sleeve and a pressing sleeve in which said pipe, said supporting sleeve and said pressing sleeve each have a longitudinal axis, said pressing sleeve having a terminating end, said supporting sleeve having an outer cylindrical surface which has an interrupted part with said interrupted part of said supporting sleeve being disposed in said pipe, said pipe having an outer periphery, said pressing sleeve being disposed about said outer periphery of said pipe, the jointing clamp comprising:

two spaced connecting plates, each of said connecting plates having an outer side;

guide plates mounted on said outer sides of said two spaced connecting plates, one of said guide plates having dual-axial engaging means adapted to engage said supporting sleeve and axially fix the axial position of said supporting sleeve on said jointing clamp in both axial directions of the longitudinal axis of said supporting sleeve;

the other of said guide plates having a form recess which is adapted to fit on the other periphery of said pipe and engage said terminating end of said pressing sleeve as a stop to stop said pressing sleeve along the longitudinal axis of said pressing sleeve;

first and second pressure clamp means pivotally mounted on said connecting plates for pivotal movement about parallel pivot axes in opposite directions between open and clamped positions, said first and second pressure clamp means being disposed between said two spaced connecting plates, said first and second pressure clamp means when said clamped position being operable to press said pressure sleeve;

said first and second pressure clamp means having engageable means which are axially spaced a predetermined distance from said one guide plate such that when said dual-axial engaging means engages said supporting sleeve to axially fix the axial position of said supporting sleeve in both axial directions, said engageable means is thereby axially aligned with said supporting sleeve at a predetermined axial position of said supporting sleeve such that said engageable means is thereby axially aligned with said interrupted part on said supporting sleeve.

2. A jointing clamp according to claim 1, wherein said engaging means comprises annular ribs, said interrupted part on said supporting sleeve comprising annular grooves.

3. A jointing clamp according to claim 1, wherein said engaging means comprises a plurality of axially spaced annular ribs, said interrupted part comprising a plurality of axially spaced annular indentations.

4. A jointing clamp according to claim 1 wherein said dual-engaging means comprises two engaging surfaces, one of said engaging surfaces engaging said supporting sleeve to prevent axial movement of said supporting sleeve in one longitudinal direction, the other of said surfaces engaging said supporting sleeve to prevent axial movement of said supporting sleeve in the opposite longitudinal direction.

5. A jointing clamp which is operable to join together a pipe, a supporting sleeve and a pressing sleeve in which said pipe, said supporting sleeve and said pressing sleeve each have a longitudinal axis, said pressing sleeve having a terminating end, said supporting sleeve having on outer cylindrical surface which has an interrupted part with said interrupted part of said supporting sleeve being disposed in said pipe, said pipe having an outer periphery, said pressing sleeve being disposed about said outer periphery of said pipe, the jointing clamp comprising:

two spaced connecting plates, each of said connecting plates having an outer side;

guide plates mounted on said outer sides of said two spaced connecting plates, one of said guide plates having dual-axial engaging means adapted to engage said supporting sleeve and axially fix the axial position of said supporting sleeve on said jointing clamp in both axial directions of the longitudinal axis of said supporting sleeve;

the other of said guide plates having a form recess which is adapted to fit on the other periphery of said pipe and engage said terminating end of said pressing sleeve as a stop to stop said pressing sleeve along the longitudinal axis of said pressing sleeve;

first and second pressure clamps pivotally mounted on said connecting plates for pivotal movement about parallel pivot axes in opposite directions between open and closed positions, said first and second pressure clamps being disposed between said two spaced connecting plates;

a first and second form insert carried respectively on said first and second pressure clamps, and a third form insert on said connecting plates, said first and second form inserts along with said third form insert being in a clamping position operable to press the pressure sleeve when said first and second pressure clamps are in said closed position, said first and second form inserts being pivotally displaced from said clamping position to a non-clamping position when said first and second pressure clamps are in said open position, said third form insert being disposed in a stationary position on said connecting plates when said third form insert is in said clamping position and when in said non-clamping position;

said first, second and third form inserts having engageable means which are axially spaced a predetermined distance from said one guide plate such that when said dual-axial engaging means engages said supporting sleeve to axially fix the axial position of said supporting sleeve in both axial directions, said engageable means is thereby axially aligned with said supporting sleeve at a predetermined axial position of said supporting sleeve such that said engageable means is thereby axially aligned with said interrupted part on said supporting sleeve.

6. A jointing clamp according to claim 5, wherein said engaging means comprises annular ribs, said interrupted part on said supporting sleeve comprising annular grooves.

7. A jointing clamp according to claim 5, wherein said engaging means comprises a plurality of axially spaced annular ribs, said interrupted part comprising a plurality of axially spaced annular indentations.

8. A jointing clamp according to claim 5 wherein said dual-engaging means comprises two engaging surfaces, one of said engaging surfaces engaging said supporting sleeve to prevent axial movement of said supporting sleeve in one longitudinal direction, the other of said surfaces engaging said supporting sleeve to prevent axial movement of said supporting sleeve in the opposite longitudinal direction.

9. A jointing clamp according to claim 5 further comprising affixing means for connecting a clamp driving device to said connecting plates, said clamp driving device being operable to drive said first and second pressure clamps from said open to said closed position.

10. A jointing clamp according to claim 9, wherein said affixing means comprising aligned openings in said two spaced connecting plates for receiving a cross bolt which bolts said clamp driving device to said two connecting plates.

11. A jointing clamp according to claim 5, wherein said first and second pressure clamps are disposed between said two spaced connecting plates, said third form insert being at least partially disposed between said two spaced connecting plates.

12. A jointing clamp according to claim 5, wherein each of said first to third form inserts extend over a portion of a circle to define a central angle indicative of the portion of the circle over which each of said first to third form inserts extend, the central angle of each of said first and second form inserts being substantially equal.

13. A jointing clamp according to claim 12, wherein the central angle of said third form insert is equal to the central angle of said first and second form inserts.

14. A jointing clamp according to claim 12, wherein the central angle of said third form insert is less than the central angle of said first and second form inserts.

15. A jointing clamp according to claim 5 further comprising first and second pivot means pivotably mounting said first and second pressure clamps respectively on said connecting plates, an imaginary line passing through the pivot axes of said first and second pivot means delineating an upper and lower portion of the jointing clamp, said third form insert having one end juxtaposed to said first form insert and another end juxtaposed to said second form insert, each of said first and second ends defining respective first and second parting planes, said parting planes having an imaginary extension extending to said lower portion of said jointing clamps to underlie the respective pivot axes.

16. A jointing clamp according to claim 5 further comprising biasing means disposed between said pressure clamps for biasing said pressures clamps toward said closed position.

17. A jointing clamp according to claim 5, wherein said first and second pressure clamps are disposed between said two spaced connecting plates, said two spaced connecting plates each having an outer side, and guide plates mounted on said outer sides of said two spaced connecting plates.

18. A jointing clamp according to claim 17, wherein each of said guide plates has a forked construction with two spaced legs, and a form recess disposed between the spaced legs of each guide plate.

19. A jointing clamp according to claim 18, wherein the form recess in each guide plate has the same configuration.

20. A jointing clamp according to claim 17 further comprising first fastening means detachably and replaceably mounting said first and second form parts on the respective first and second pressure clamps, and second fastening means detachably and replaceably fastening said guide plates to said two spaced connecting plates.

21. A jointing clamp according to claim 20, wherein said third form insert has at least one part disposed between said two spaced connecting plates, said second fastening means engaging said one part of said third form recess to thereby detachably mount said third form insert on said two spaced connecting plates.

22. A jointing clamp according to claim 17, wherein each of said two spaced connecting plates has a generally U-shaped configuration which includes two spaced leg portions, first pivot means pivotably mounting said first pressure clamp to one of said leg portions, second pivot means pivotably mounting said second pressure clamp to the other leg portion.

23. A jointing clamp according to claim 17, wherein each of said first to third form inserts and said guide plates are detachably and replaceably mounted on said first and second pressure clamps and on said two spaced connecting plates, said first to third form inserts forming a closed circle when in said clamping position, said first form insert being spaced from said second and third form inserts when in said non-clamping position, said second form insert being spaced from said first and third form inserts when in said non-clamping position.

24. The method of joining together a pipe, a supporting sleeve and a pressing sleeve in which said pipe, said supporting sleeve and said pressing sleeve each have a longitudinal axis, said supporting sleeve having an outer cylindrical surface which has an interrupted part, the process comprising the steps of:

disposing said supporting sleeve in said pipe and disposing said pressing sleeve about said pipe to form a pre-assembled unit of the supporting sleeve within the pipe and the pipe within the pressing sleeve;

applying a jointing clamp having pressing members with ribs to said pre-assembled unit;

limiting axial moving of said supporting sleeve in both axial directions in said jointing clamp by engaging said supporting sleeve with said jointing clamp and thereby positioning said interrupted part of said supporting sleeve at a fixed predetermined position on said jointing clamp;

said step of limiting axial movement of said supporting sleeve in both axial positions to position said interrupted part in said predetermined position effecting positioning said interrupted part in axial alignment with said ribs on said pressing member such that said ribs radially overlie said interrupted part;

causing said jointing clamp to apply a generally radially inwardly directed pressing force to said pre-assembled unit such that said pressing sleeve, said pipe and said supporting sleeve are all radially pressed together with said ribs pressing radially inwardly toward the axially aligned underlying interrupted part of said supporting sleeve;

said pressing sleeve having a longitudinal end, and further comprising limiting axial movement of said pressing sleeve in one axial direction in said jointing clamp by engaging said terminating end of said pressing sleeve with said jointing clamp.

25. The method of joining together a pipe, a supporting sleeve and a pressing sleeve in which said pipe, said supporting sleeve and said pressing sleeve each have a longitudinal axis, said supporting sleeve having an outer cylindrical surface which has an interrupted part, the process comprising the steps of:

disposing said supporting sleeve in said pipe and disposing said pressing sleeve about said pipe to form a pre-assembled unit of the supporting sleeve within the pipe and the pipe within the pressing sleeve;

applying a jointing clamp having pressing members with ribs to said pre-assembled unit;

limiting axial moving of said supporting sleeve in both axial directions in said jointing clamp by engaging said supporting sleeve with said jointing clamp and thereby positioning said interrupted part of said supporting sleeve at a fixed predetermined position on said jointing clamp;

said step of limiting axial movement of said supporting sleeve in both axial positions to position said interrupted part in said predetermined position effecting positioning said interrupted part in axial alignment with said ribs on said pressing member such that said ribs radially overlie said interrupted part;

causing said jointing clamp to apply a generally radially inwardly directed pressing force to said pre-assembled unit such that said pressing sleeve, said pipe and said supporting sleeve are all radially pressed together with said ribs pressing radially inwardly toward the axially aligned underlying interrupted part of said supporting sleeve;

said step of limiting axial movement of said supporting sleeve in both axial directions comprising providing first engaging surfaces on the outer periphery of said supporting sleeve and second engaging surfaces on said jointing clamp, said interrupted part including annular recesses in said supporting sleeve, said limiting step further comprising effecting engagement between said first and second engaging surfaces to limit axial movement of said supporting sleeve in both axial directions and thereby positioning said annular recesses to radially underlie said jointing clamp.

* * * * *